US007101288B2

(12) United States Patent
Thomas

(10) Patent No.: US 7,101,288 B2
(45) Date of Patent: Sep. 5, 2006

(54) GOLF CLUB HAVING AN ALIGNMENT DEVICE THEREON

(75) Inventor: Frank Thomas, Chester, NJ (US)

(73) Assignee: Frankly Golf LLC, Champions Gate, FL (US)

( * ) Notice: Subject to any disclaimer, the term of this patent is extended or adjusted under 35 U.S.C. 154(b) by 0 days.

(21) Appl. No.: 09/845,280

(22) Filed: Apr. 30, 2001

(65) Prior Publication Data

US 2002/0160849 A1 Oct. 31, 2002

(51) Int. Cl.
*A63B 69/36* (2006.01)
*A63B 53/06* (2006.01)

(52) U.S. Cl. ..... 473/242; 473/337; 473/254; 473/251; 273/DIG. 14

(58) Field of Classification Search ..... 473/333, 473/334, 335, 336, 337, 338, 339, 340, 341, 473/327, 349, 238, 268, 242, 252, 251, 313, 473/324, 282, 253, 254; D21/742–751; 273/DIG. 14
See application file for complete search history.

(56) References Cited

U.S. PATENT DOCUMENTS 1,133,129 A * 3/1915 Govan
1,291,967 A * 1/1919 McDougal ..... 473/251
1,433,150 A * 10/1922 Reach
2,003,951 A * 6/1935 Pepin
3,333,854 A * 8/1967 White ..... 473/288
3,847,399 A * 11/1974 Raymont
3,873,094 A * 3/1975 Sebo
4,693,478 A * 9/1987 Long ..... 473/251
5,246,227 A * 9/1993 Sun
5,301,941 A * 4/1994 Allen
5,839,974 A * 11/1998 McAllister
6,200,227 B1 * 3/2001 Sery
6,422,949 B1 * 7/2002 Byrne et al. ..... 473/200

FOREIGN PATENT DOCUMENTS

JP 405329233 * 12/1993 ..... 273/167 J

* cited by examiner

*Primary Examiner*—Sebastiano Passaniti
(74) *Attorney, Agent, or Firm*—Francis C. Hand; Carella, Byrne, Bain etal

(57) ABSTRACT

A golf club, and particularly a putter, is provided with an alignment line which extends along a length of the putter shaft and a length of the putter head. The alignment line is disposed in a plane perpendicular to the axis of the shaft and parallel to the face of the putter head and allows a golfer to align the face of the club perpendicular to an imaginary line along which a golf ball is to be driven. The body of the putter head is a skeletal frame and is covered with a plastic coating to fill up the openings in the body and provide a flat striking surface.

21 Claims, 2 Drawing Sheets

GOLF CLUB HAVING AN ALIGNMENT DEVICE THEREON

This invention relates to a golf club having an alignment device thereon. More particularly, this invention relates to a putter having an alignment device thereon. Still more particularly, this invention relates to a putter having a head utilizing a skeletal frame.

As is known, golf clubs are constructed with a shaft and various types of heads. Typically, the heads are provided with a flat face for striking a golf ball. During play, a golfer uses the clubs to drive a ball toward a desired area of a fairway or a spot on a green. To this end, the striking face of the golf club should impact the ball so as to drive the ball straight toward the area or spot desired. In some cases, golf club heads have been provided with an alignment mark to visually indicate to a golfer the direction in which the head is to be swung in order to drive the golf ball in the desired direction. In one case, a pair of spaced apart parallel lines have been placed on the back of a club head to enable a golfer to visually align the head relative to a ball and to the desired direction of travel. However, depending on the manner in which the golfer grips the club, the shaft may obscure the lines from view.

As is also known, a putter is a club designed primarily for use on a putting green. The object being to strike a ball with a head of the club with the intent of having the ball, finally, come to rest in a hole cut into the green. To do this most effectively, the putter face (the striking surface) must be properly aligned such that when the club strikes the ball, the ball will rebound off the club in the intended direction, generally directly toward the hole, if the putted ball is not diverted by undulations on the green or something else which could influence the path of the ball. Under these latter conditions, the intended initial direction may be other than directly toward the hole and, thus, the alignment would be in that direction. Once the direction of the putt is established by the golfer by whatever method he/she chooses to use, the putter face is aligned in such a manner to perform the function.

It has also been known to construct a putter with a cavity back weighted perimeter in order to reduce the mass of the putter and to otherwise position the moment of inertia of the club head at the "sweet spot" of the putter.

It is an object of this invention to enhance the ability of a golfer to align a putter such as to strike and drive a ball in an intended direction.

It is another object of this invention to enhance the ability of a golfer to align a golf ball with a cup on a green.

It is another object of the invention to facilitate the alignment of a putter with a golf ball to be putted into a cup on a green.

It is another object of the invention to enhance the ability of a user to align an implement for driving another element.

It is another object of the invention to provide an improved head for a putter.

It is another object of the invention to utilize frame technology in the manufacture of a head for a putter.

Briefly, the invention provides the shaft and head of a golf club with a visible alignment device which extends along a surface of the shaft and a surface of the head in a common plane with the longitudinal axis of the shaft and parallel to a striking face on the head.

Preferably, the alignment device is in the form of a continuous line or a discontinuous line which extends along a substantial length of the shaft and a substantial length of the head of the club.

After a golfer has determined the path in which a golf ball is to be directed, for example, to be putted on a green towards a cup, the alignment device on the club, a putter in this case, is used by the golfer to align the putter with the cup. That is to say, when addressing the golf ball, the golfer visually aligns the alignment line on the putter with his/her eye so that the plane of the line is perpendicular to an imaginary line from the cup to the face of the club head. Thus, by keeping the alignment line perpendicular to this imaginary line when addressing the ball and subsequently when the putter is swung forwardly toward the cup, the face of the putter should strike the ball so that the ball rolls forwardly along the imaginary line directly toward the cup.

Where the green has undulations between the ball and the cup, the golfer may make select a spot on the green toward which the ball is to be putted to compensate for the undulations. In this case, the plane of the alignment line is made perpendicular to the spot on the green towards which the ball is to be directed.

The invention further provides a head for a putter which is comprised of a metal body having a plurality of openings passing therethrough to define a skeletal frame and a pair of weighted plugs which are disposed near the heel and toe of the body to increase the weight thereat. In addition, the head has a plastic coating covering the body and plugs while filling the remaining openings in the body and while defining a flat striking face on one side of the head.

The metal body of the putter head is manufactured to obtain a relatively lightweight body while being sufficiently strong to achieve a putting function. The body of the club may be made of any suitable metal such as brass, aluminum, or any other metals which are suitable for the manufacture of heads for putters. The terminology "frame technology" is coined herein to describe the technology to determine the placement and size of the openings which are made through the metal body.

The use of weighed plugs, one in the heel of the body and one in the toe of the body, allows the moment of inertia of the overall putter head to be positioned centrally of the head and particularly at the sweet spot for the putter head. These weights may be made of any suitable material, for example tungsten.

The plastic coating which is used to form the exterior surfaces of the putter head may be made of any suitable plastic such as urethane and may be made of any suitable thickness such as 1/64". The composite construction of the head is such that the plastic coating forms the striking face thereby allowing a user to obtain a "soft feel" when putting a golf ball.

In addition to having a first alignment line extending across the head of the putter in a plane parallel to the striking face, a second line is inscribed in the head to extend across the head perpendicularly of the first line. This second line allows a user to align the putter head with a golf ball to be putted.

The putter head may also be provided with a flange that extends from a bottom of the body with the plastic coating covering the flange. In this respect, the flange may be made of solid urethane. However, for manufacturing purposes, the flange is cast or molded to be integral with the head and therefore is made of the same material as the head. After the head and flange have been fabricated, the plastic coating is applied over the flange and head to form a complete covering while filling the openings remaining in the head.

The provision of a flange on the head adds additional weight to the head and locates the moment of inertia at a lower point. In addition, the flange follows the contour of the bottom of the body and is curved in a plane transverse to the body. Typically, the body is made with a rocker sole, i.e. a rounded bottom, so that the flange is curved in the same manner.

In order to enhance the alignment of the putter head with a golf ball, the flange is provided with a third line which extends across the flange in a plane perpendicular to the first line on the head while being co-planar with the second cross-line on the body. When in use, a golfer would visually align the line on the flange with the cross-line on the head to thereby position the head of the golfer over the golf ball.

These and other objects and advantages of the invention will become more apparent from the following detailed description taken in conjunction with the accompanying drawings wherein.

Figure 1:
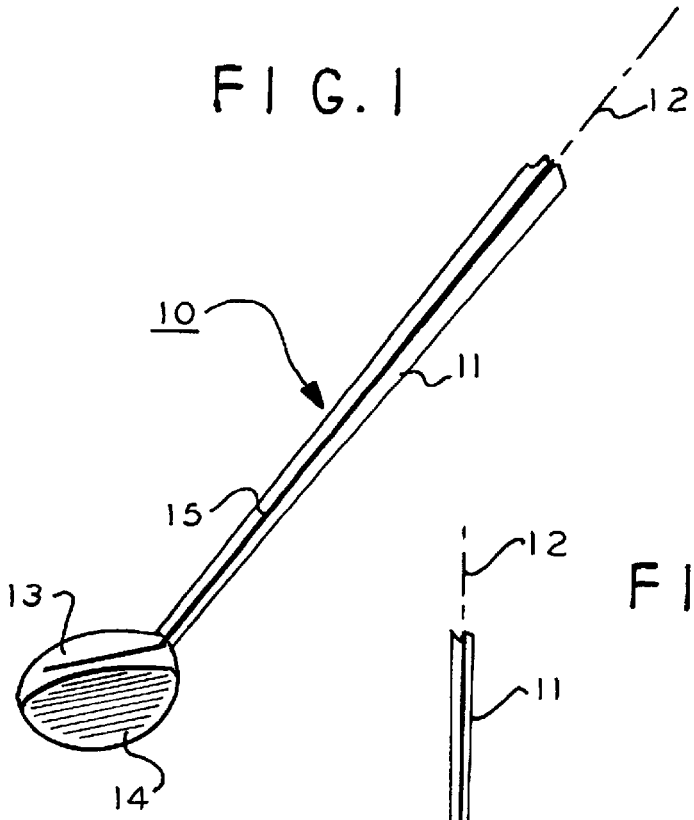
FIG. 1 illustrates a perspective view of a golf club having an alignment device thereon.

Referring to FIG. 1, the golf club 10 is made of any conventional and approved structure and includes a shaft 11 having a longitudinal axis 12 and a head 13 extending laterally from one end of the shaft 11 and having a flat striking face 14 thereon. As is known, golf clubs are manufactured in various shapes and forms. Accordingly, the term "shaft" is employed in a generic sense for all golf clubs which are approved for play pursuant to the rules of the USGA. Likewise, the term "head" is employed generically for all heads of golf clubs which are approved for play.

In accordance with the invention, the golf club 10, for example, a putter, is provided with an alignment device in the form of a line 15 which extends along a surface of the shaft 11 and the surface of the head 13. This line 15 may also be embedded in the shaft 11 and head 13 but visible. The line 15 has two portions or legs that are disposed at an angle to each other and that are in the same plane as the longitudinal axis 12 of the shaft 11. In addition, the plane of the line 15 is parallel to the striking (putting) face 14 of the head 13.

Figure 2:
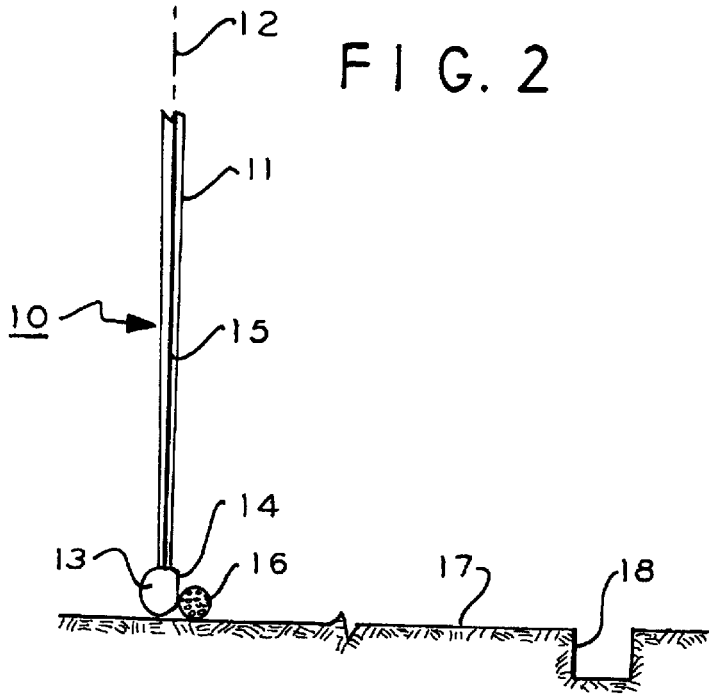
FIG. 2 illustrates a side view of the golf club at a moment of impact with a golf ball on a green in accordance with the invention.

As shown in FIG. 1, the alignment device 15 may be a continuous line or as shown in FIG. 2, the alignment device may be a discontinuous line. In either embodiment, the line 15 extends along a substantial portion of the shaft 11 and also extends along a substantial length of the head 13. Further, in either case, the line 15 may be inscribed in the shaft 11 and head 13 at or shortly after the time of manufacture so long as the line 15 remains visible. Also, the alignment device 15 may be added to existing clubs, for example, by using a suitable inscribing tool, by using a suitable ink, or any other suitable technique.

Figure 3:
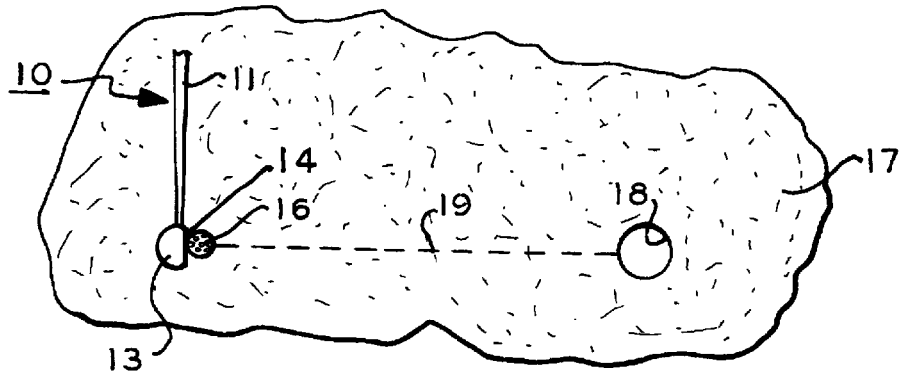
FIG. 3 illustrates a schematic plan view of the golf club at a moment of impact with a golf ball in accordance with FIG. 2.

Referring to FIGS. 2 and 3, by way of example, when a golfer is ready to putt a ball 16 along a green 17 into a cup 18, the putter 10 is positioned adjacent to the golf ball 16. The putter 10 is then manipulated so that the plane of the alignment line 15 is visually placed perpendicular to an imaginary line 19 extending between the cup 18 and the face 14 of the club (see FIG. 3). Assuming that the green 17 is flat between the ball 16 and the cup 18, the golfer would then swing the putter 10 toward the cup 18 while maintaining the plane of the alignment line 15 perpendicular to the imaginary line 19. Upon impact with the golf ball 16, the putter 10 would putt the ball 16 forwardly along the imaginary line 19 toward the cup 18.

Assuming that the alignment line 15 is properly aligned with the imaginary line 19, the striking face 14 of the putter 10 would also be perpendicular to the imaginary line 19. Upon impact of the putter 10 on the golf ball 16, the golf ball 16 should then be driven along the imaginary line 19 towards and, hopefully, into the cup 18.

If the green 17 has undulations between the lie of the ball 16 and the cup 18, the golfer may pick out a spot between the ball and the cup to which the golfer wishes to direct the ball. Again, the alignment line 15 would be used to place the plane of the face 14 of the head 13 perpendicular to the imaginary line between the face 14 and the "spot". After being impacted by the putter 10, the ball would be directed towards the "spot" with the path of the ball being influenced by the undulations of the green.

Thus, rather than relying upon the golfer's visual estimate as to when the striking face of a golf club is aligned perpendicular to an imaginary line to a desired area of a fairway or spot on a green, the alignment line 15 allows the golfer to use the shaft and head of the club to visually align the striking face of the club perpendicular to the imaginary line.

Figure 4:
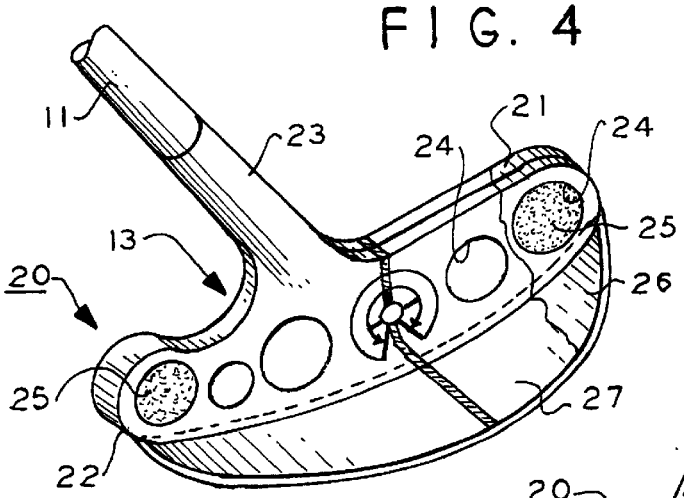
FIG. 4 illustrates a perspective view of a putter head constructed in accordance with the invention.

Referring to FIG. 4, wherein like reference characters indicate like parts as above, a putter 20 is provided with a head 13 of composite construction formed in accordance with the frame technology of the invention. To this end, the head 13 has a metal body 21, for example, being made of brass, aluminum or any other suitable metal. The body 21 is of generally oblong shape with a rocker sole 22 (FIG. 5), a flat front, a flat back and an integral hosel 23 to receive a shaft 11. The body 21 also has a plurality of openings 24 (six openings as shown) that pass through from front to back to define a skeletal frame. As illustrated, the openings 24 are circular and are of different diameters. However, the openings may be of any suitable shape and size in order to reduce the mass of the head 21. Typically, the size and position of the openings 24 are determined so as to place the center of mass of the head 21 at a fixed point between the heel and toe of the head 21.

As illustrated, a weighed plug 25 is disposed in an opening 24 in each of the heel and toe of the body 21 in order to increase the weight of the heel and toe. In this respect, the weight of each plug 25 is determined so as to position the moment of inertia of the head 21 at a specific point and particularly at the sweet spot of the head 21.

Figure 6:
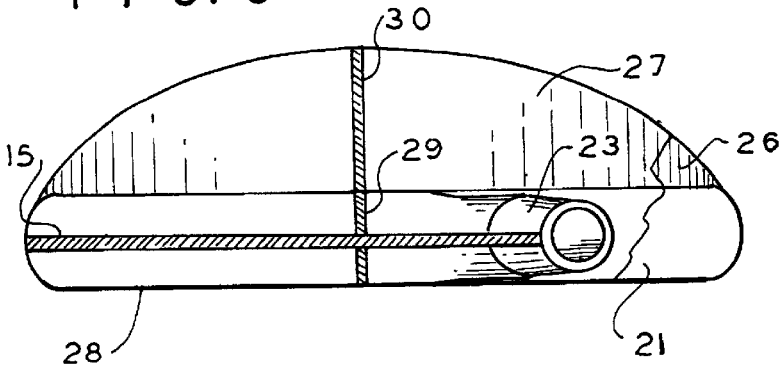
FIG. 6 illustrates a top view of the putter head of FIG. 4.
Figure 7:
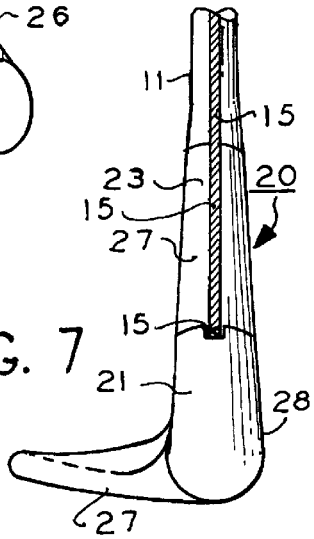
FIG. 7 illustrates a side view of the putter head of FIG. 4.

Referring to FIGS. 4, 6 and 7, a flange 26 extends from the bottom of the body 21. Typically, the flange 26 is integral with the body 21 and is made of the same material. For example, the flange 26 is cast or molded with the body 21.

Figure 5:
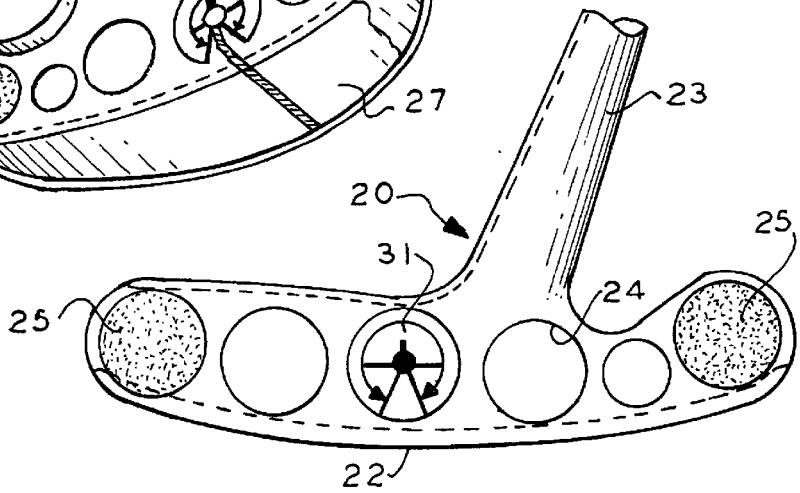
FIG. 5 illustrates a rear view of the putter head of FIG. 4.

Referring to FIG. 5, the rocker sole 22 has a curved shape to allow a golfer to adjust the putter 20 to the golf's comfort zone when addressing a golf ball to be putted. The flange 26 by extending from the bottom of the head 21 also has the same curvilinear shape as the rocker sole 22. In addition, the flange 26 is curved in a plane transverse to the body 21 as indicated in FIG. 6.

The use of the flange 26 on the head 30 is optional. When used, the flange enhances the visual alignment of the putter with an imaginary line between the putter and the point to which a golf ball is to be directed. In addition, when a flange 26 is used, the location and size of the openings 24 and the weight and size of the plugs 25 would be recalculated to precisely position the center of mass of the resulting composite putter head 20.

Referring to FIG. 4, a plastic coating 27 covers the body 21 and flange 26 while also filling the openings 24 to define a flat striking face 28 (see FIGS. 6 and 7) on the front of the head 21. Typically, the plastic coating is transparent. The coating 27 may be of any suitable thickness, for example, 1/64 inch. When a golf ball is struck by the putter 20, the coating 27 provides a cushioned or soft feel to a putt rather than a metal-to-ball feel.

As above, an alignment line 15 extends along the upper surface of the head 21 in a plane parallel to the striking face 28 and continues upwardly along the hosel 23 of the head 21 and matches a similar line 15 extending along the shaft 11, for example, for an upward distance of twelve inches. As shown in FIG. 7, the line 15 is defined by a groove in the upper surface of the head 21.

Referring to FIGS. 4 and 6, a second line 29 extends across the body 21 perpendicularly of the line 15. This second line 29 is positioned on the body 21 at a point where the center of mass of the head 20 is located. This line 29 serves to align the flat striking face 28 of the head 20 with a golf ball.

In addition, a line 30 extends across the flange 26 in a plane perpendicular to the line 15 and co-planar with the cross-line 29. When a golfer views the lines 29 and 30 from above so that the lines 29, 30 are co-planar as indicated in FIG. 6, the eyes and head of the golfer will be directly over the ball to be putted. Should the head of the golfer move perpendicularly of the plane of the two lines 29, 30, the lines 29, 30 would be seen as displaced from each other and not co-planar.

As indicated in each of FIGS. 4 and 5, a logo 31 or the like may be embossed or otherwise disposed in the coating 27 over a centrally placed opening 24 in the head 21.

The invention thus provides a golfer with a simple means which can be visualized to aid in placing the striking face of a golf club, and particularly a putter, in a plane perpendicular to a line between the striking face and a spot on the green, for example, a cup or between the striking face and an area of a fairway. Further, the alignment line is placed on the shaft and head so that the line may be viewed at all times without being obscured by the shaft.

The invention further provides an alignment device which may be placed on an implement used to move another element to ensure that the implement is moved in a desired path in order to move the driven element for various purposes.

The invention further provides a device which can be used on any type of golf club to align a striking face of the golf club perpendicular to an imaginary line of desired flight of a golf ball.

The invention also provides a putter which has several unique features. First, the use of the alignment lines on the putter enables a golfer to visually align the striking face of the putter perpendicular to an imaginary line. Second, the use of frame technology to construct the body of the putter head as a skeletal frame allows the center of mass of the body to be located in a very precise manner. Third, the use of a plastic coating not only provides a smooth flat striking surface but also allows for a soft cushioned feel to a putter when putting.

What is claimed is:

1. A putter comprising a shaft having a longitudinal axis;

a head secured to one end of said shaft, said head including a metal body having a plurality of openings passing therethrough to decrease the mass of said body and a plastic coating covering said body and filling said openings to define a flat striking face on one side of said head; and a pair of weighted plugs, each said plug being disposed in a respective opening in said head near a heel and toe of said head to increase the weight of said heel and toe.

2. A putter as set forth in claim 1 which further comprises a flange extending from a bottom of said body with said plastic coating covering said flange.

3. A putter as set forth in claim 2 wherein said body has a rocker sole and said flange has a curvilinear shape corresponding to said rocker sole.

4. A putter as set forth in claim 3 wherein said flange is curved in a plane transverse to said body.

5. A putter as set forth in claim 2 which further comprises an alignment means extending along a surface of said shaft and said head in a plane perpendicular to said longitudinal axis of said shaft and parallel to said striking face of said head.

6. A putter as set forth in claim 5 wherein said alignment means is a line inscribed in said shaft and said head.

7. A putter as set forth in claim 6 which further comprises a line extending across said head perpendicularly of said line inscribed in said head and a line extending across said flange in a plane perpendicular to said line inscribed in said head and co-planar with said line extending across said head.

8. A putter as set forth in claim 2 wherein said coating is made of urethane.

9. A putter as set forth in claim 2 wherein said coating is transparent.

10. A putter as set forth in claim 2 wherein said head has a rocker sole.

11. A head for a putter comprising a metal body having a plurality of openings passing therethrough to define a skeletal frame;

a pair of weighted plugs, each said plug being disposed in a respective opening in said body near a heel and toe of said body to increase the weight of said heel and toe; and a plastic coating covering said body and filling said openings to define a flat striking face on one side of said head.

12. A head for a putter as set forth in claim 11 which further comprises a flange extending from a bottom of said body with said plastic coating covering said flange.

13. A head for a putter as set forth in claim 12 wherein said flange is integral with said body.

14. A head for a putter as set forth in claim 12 wherein said body has a rocker sole and said flange has a curvilinear shape corresponding to said rocker sole.

15. A head for a putter as set forth in claim 14 wherein said flange is curved in a plane transverse to said body.

16. A head for a putter as set forth in claim 12 which further comprises a first alignment line extending across said head in a plane parallel to said striking face, a second line extending across said head perpendicularly of said first line and a third line extending across said flange in a plane perpendicular to said first line and co-planar with said second line.

17. A head for a putter as set forth in claim 11 wherein said coating is made of urethane.

18. A head for a putter as set forth in claim 11 wherein said coating is transparent.

19. A head for a putter as set forth in claim 11 wherein said coating has a thickness of 1/64 inch.

20. A head for a putter as set forth in claim 11 wherein said head has a rocker sole.

21. A head for a putter as set forth in claim 11 wherein each said plug is made of tungsten.

* * * * *